US009557093B2

(12) United States Patent
Güvendiren

(10) Patent No.: US 9,557,093 B2
(45) Date of Patent: Jan. 31, 2017

(54) INDUSTRIAL DEHUMIDIFIER SYSTEM

(71) Applicant: Cem Güvendiren, Istanbul (TR)

(72) Inventor: Cem Güvendiren, Istanbul (TR)

(73) Assignee: MEKANO ELEKTRONIK TEKNIK SANAYI VE TICARET LIMITED SIRKETI, Istanbul (TR)

( * ) Notice: Subject to any disclaimer, the term of this patent is extended or adjusted under 35 U.S.C. 154(b) by 250 days.

(21) Appl. No.: 14/321,170

(22) Filed: Jul. 1, 2014

(65) Prior Publication Data

US 2016/0003516 A1 Jan. 7, 2016

(51) Int. Cl.
*F25D 17/06* (2006.01)
*F25D 17/04* (2006.01)
*F24F 3/14* (2006.01)

(52) U.S. Cl.
CPC ..... *F25D 17/042* (2013.01); *F24F 3/1417* (2013.01); *F24F 2003/144* (2013.01)

(58) Field of Classification Search
CPC ..... B01D 53/265; F24F 3/1405; F24F 3/1423
USPC ..... 62/93, 140, 271, 288, 324.1
See application file for complete search history.

(56) References Cited

U.S. PATENT DOCUMENTS 2,284,914 A * 6/1942 Miller ..... F24F 3/1417 165/222
4,939,906 A 7/1990 Spatz et al.
5,213,154 A 5/1993 Marsala et al.
5,421,169 A * 6/1995 Benedict ..... B60H 1/00007 165/42
5,509,275 A * 4/1996 Bhatti ..... B60H 3/024 165/7
6,514,321 B1 2/2003 Lehto et al.
7,938,888 B2 5/2011 Assaf
8,268,060 B2 9/2012 Hargis et al.
2010/0090356 A1 4/2010 Sines et al.
2011/0132027 A1 6/2011 Gommed et al.
2013/0269522 A1 10/2013 DeValve

FOREIGN PATENT DOCUMENTS

WO 2013172789 A1 11/2013

* cited by examiner

*Primary Examiner* — Melvin Jones
(74) *Attorney, Agent, or Firm* — Egbert Law Offices, PLLC

(57) ABSTRACT

A dehumidifier system has a solution, a refrigerant, a first heat exchanger cooperative with the solution so as to pass a warmed solution therefrom, a second heat exchanger cooperative with the warmed solution so as to increase in temperature of the warmed solution, a radiator, a fan cooperative with the radiator such that the fan blows air across the radiator as the warmed solution is passed through or along the radiator and such that the air absorbs moisture and increases in temperature is the air passes through the radiator, and an evaporator having the refrigerant passing along or through thereof. The evaporator cooperates with the increased temperature air such that heat from the increased temperature air is transferred to the refrigerant and such that moisture is created therefrom. A compressor is cooperative with the evaporator and with the second heat exchanger so as to pressurize the refrigerant passing into the second heat exchanger.

19 Claims, 1 Drawing Sheet

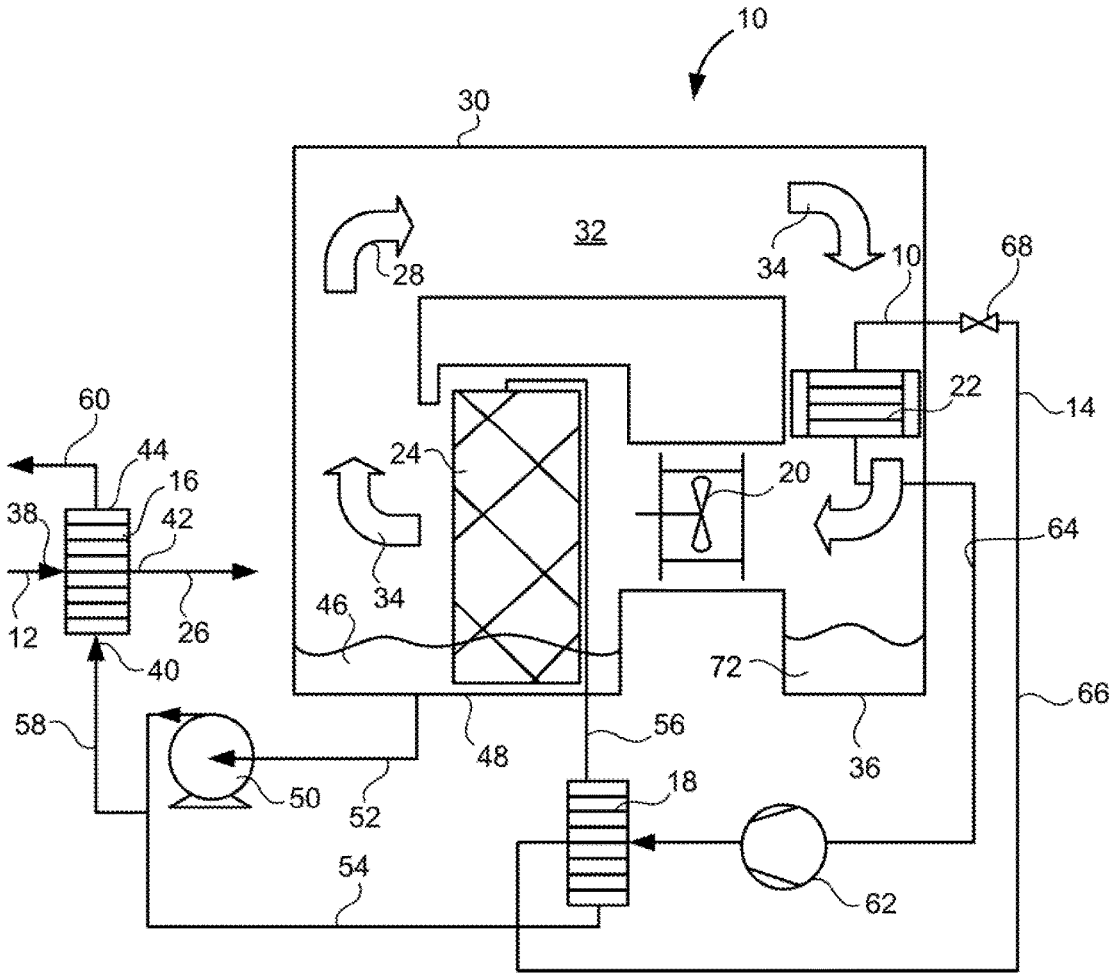
10
30
32
28
34
10
68
22
14
60
44
16
38
42
24
20
64
12
26
34
46
40
72
66
58
56
48
36
50
52
18
54
62

INDUSTRIAL DEHUMIDIFIER SYSTEM

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to dehumidification systems. More particularly, the present invention relates to industrial-type dehumidifiers having a heat pump, receiver/dryer, and closed-cycle regeneration. Additionally, the present invention relates to dehumidifiers in which the receiver/dryer relies on energy used for dehumidification instead of heat transfer.

2. Description of Related Art Including Information Disclosed Under 37 CFR 1.97 and 37 CFR 1.98.

Air humidity control has historically been important in providing comfortable working and living environments and for the preservation of assets, such as historical documents. Recently, it has become even more critical for certain environments, such as hospital operating theaters, electronics manufacturing facilities and pharmaceutical production process areas. In addition, humidity control improves the economics of refrigeration on, for example, supermarket display cases, by eliminating or reducing defrost cycles or the use of the anti-sweat heater.

Basic humidity reduction is typically accomplished at the cooling coil of an air conditioning system. If the coil temperature is below the dew point of the air stream entering the coil, excess moisture collects on the coils, producing a condensate stream. In such a system, the goal is control of the air stream temperature, with some reduction in humidity. In contrast, by adding a sensor to measure humidity (humidistat), air is cooled as needed, in response to the humidistat, to maintain a desired humidity level. Such systems provide either temperature control or humidity control, but not both. A separate heating or cooling system must be added in series with the humidity control coil to achieve both temperature and humidity control. This can increase energy costs. For example, often the cooling necessary to reach a desired humidity results in overcooling the air stream, requiring subsequent reheating of the air stream to achieve the desired temperature and humidity. Some systems are able to alleviate energy cost penalty by using waste heat elsewhere in the system (e.g., condenser heat). However, the components necessary to reclaim the waste heat and transfer it to the air stream add to the installation cost of the system. Where low-humidity conditions are needed, coil temperatures must be correspondingly low. If the coil temperature is maintained by a vapor compression system, the compressor must work harder and use more energy to reach the lower temperature, resulting in a reduced chiller coefficient of performance (COP).

Other mature technologies exist for dehumidification, other than by a cooling coil. Desiccant wheels and enthalpy wheels, honeycombed wheels having surfaces covered with a solid desiccant, such as silica gel, are often used to remove moisture from an air stream. The wheels rotate between supply and exhaust air streams to transfer water and heat between them. Desiccant wheels can achieve very low dew points by using a heated exhaust air stream to greatly enhance the removal of adsorbed water, creating a very dry desiccant for contact with the supply air stream. Such a system needs a lot of energy to heat the exhaust air and additional cooling of the supply air stream to remove heat transferred from the exhaust air to the wheel and subsequently to the supply air stream. In contrast, enthalpy wheels have a lighter coating of desiccant and are primarily designed to transfer energy in the forms of heat (sensible heat) and moisture (latent heat) from one stream to another without any additional energy. The amount of moisture removed depends on the dryness of the exhaust air. As such, enthalpy wheels are more limited than desiccant wheels regarding the level of humidity control they can maintain. Combinations of desiccant and enthalpy wheels, along with the use of waste heat from elsewhere or water for evaporative cooling, can improve the level of humidity control as well as the energy efficiency of the system, but at a significant penalty in initial cost and complexity of the system.

Liquid desiccant dehumidifiers are another currently available alternative for removing moisture from air. A hygroscopic fluid (one that readily adsorbs water from the air), such as a LiCl solution, circulates between supply and exhaust air streams. The solution picks up moisture from the supply air stream, essentially diluting the solution, which then circulates to the exhaust air stream where heat evaporates the excess moisture into the exhaust air stream. In addition to the energy needed to heat the liquid to evaporate the moisture on the exhaust air side, additional energy is necessary on the supply air side to remove the heat of condensation either by sub-cooling the liquid before contact with the supply air or by cooling the supply air after dehumidification. As with the systems discussed above, to ease this energy penalty, waste heat from elsewhere can be used to evaporate the moisture, at higher initial cost and complexity for the system.

In the past, various patents have issued relating to liquid desiccant dehumidification systems. For example, U.S. Pat. No. 4,939,906, issued on Jul. 10, 1992 Spatz et al., describes a multi-stage boiler/regenerator for liquid desiccant dehumidifiers. In this system, a gas-fired desiccant boiler and a combined desiccant regenerator/interchange heat exchanger is used. The combined re-generator/heat exchanger utilizes steam produced from the boiler to provide heat for partial regeneration. The desiccant boiler has a liquid/vapor separator chamber and a thermosyphon recirculation to reduce scale and corrosion of the boiler.

U.S. Pat. No. 5,213,154, issued on May 25, 1993 to Marsala et al., shows a liquid desiccant regeneration system for use in an air-conditioning system. The regeneration system utilizes a falling film heat exchanger for transferring heat from concentrated desiccant so as to dilute the desiccant. A boiler is used for regenerating dilute desiccant. Piping is provided for flowing the dilute desiccant from the air-conditioning system upward through the heat exchanger.

A flow path directs the concentrated desiccant from the boiler through the heat exchanger into the air-conditioning system. This patent only relates to an exchanger used in a regeneration process. It does not relate to a entire dehumidification system.

U.S. Pat. No. 6,514,321, issued on Feb. 4, 2003 to Lehto et al., describes a dehumidification system utilizing desiccants and multiple effect evaporators. The desiccant the solution from the multiple effect evaporator is conveyed to a desiccant spray chamber that sprays the cooled desiccant solution into an airstream. The desiccant solution absorbs water vapor from the air stream creating a desiccant and water solution. A conduit transfers the water and desiccant solution to the multiple effect evaporator for removal of the water from the desiccant solution.

U.S. Pat. No. 7,938,888, issued on May 10, 2011 to G. Assaf, teaches a liquid desiccant regenerator system including a desiccant/air heat exchanger having a first desiccant inlet and a desiccant reservoir. The reservoir has a first desiccant outlet, a second desiccant outlet and a second desiccant inlet. The first desiccant inlet and the first desiccant outlet are connectable to a heat source. The second desiccant inlet conducts diluted desiccant of the reservoir and the second desiccant outlet conducts concentrated desiccant from the reservoir. The second desiccant inlet and the desiccant outlet are connected to a desiccant/desiccant heat exchanger for applying heat to the diluted desiccant flowing into the reservoir. Water is heated with moisturized hot air and the heat of this water is transferred into the internal environment in order to generate water by condensing the moisturized hot water in regeneration. Water releasing its energy is then transferred into the same chamber to be used in order to cool the moisturized hot air. In this manner, thermal energy is transferred into the environment. This system is carried out with a heating or cooling of the environment.

U.S. Pat. No. 8,268,060, issued on Sep. 18, 2012 to Hargis et al., provides a dehumidifier system having a dehumidifier section within which liquid desiccant absorbs moisture from air flowing therethrough and a dehumidifier section within which the desiccant is regenerating that employs a heat exchanger for maintaining a relatively high temperature differential between the desiccant contained within the dehumidifier and the regenerator sections. The desiccant is conducted to either the dehumidifier section or the regenerator section and is separated into multiple streams. The multiple streams are treated differently from one another before being discharged to preselected segments of the air flow moving through the corresponding one of the dehumidifier section and the regenerator section. This process is realized with a heat pump between regeneration (with external environmental air) and dehumidifying (with internal environmental air). The system requires external environmental air. Additionally, the system requires thermal energy transfer into the internal environmental air.

U.S. Patent Publication No. 2010/0090356, published on Apr. 15, 2010 to Sines et al., teaches a liquid desiccant dehumidifier in which a liquid desiccant solution is used to extract moisture from ambient air in a first location within a dehumidifier. A regenerator is in fluid communication with the dehumidifier so as to extract moisture from the liquid desiccant solution. One or more pumps circulate the liquid desiccant through the dehumidifier. One or more pumps also circulate the liquid desiccant through the regenerator. The base exposes the liquid desiccant solution at least partially to the ambient air.

U.S. Patent Publication No. 2011/0132027, published on Jun. 9, 2011 to Gommed et al., describes a liquid desiccant dehumidification system and heat/mass exchanger therefor. The exchanger has an absorber solution section operably connected to the system's absorber/dehumidification system and a desorber solution section operably connected to the desorber/regeneration section. A partition separates the sections and includes at least two interconnecting ports positioned to facilitate flow of a relatively weak solution from the absorber solution section into the desorber solution section.

U.S. Patent Publication No. 2013/0269522, published on Oct. 17, 2013 to D. D. DeValve, is a heat pump-enabled desiccant dehumidification system that includes a heat pump with a desiccant-coated passive heat transfer device on both sides of the heat pump and an air circulation system for alternately directing a process airstream to be humidity controlled and a separate regenerative airstream past each side. As desiccant on one side becomes laden with moisture, the air streams are redirected to the opposite sides of the heat pump so the regenerative stream removes moisture from the first side. Simultaneously, the airstream to be humidity-controlled uses the previously regenerated desiccant on the second side.

International Publication No. WO/2013/172789, published on Nov. 21, 2013 to Cai et al., describes a dehumidifying system having a dehumidifier containing a desiccant for dehumidifying a process airflow and a regenerator to regenerate the desiccant. The dehumidifier has a cooler connected to the dehumidifier. The cooler is designed to cool the desiccant such that the desiccant is cooled by the cooler before entering the dehumidifier. The regenerator has a heater connected thereto. The heater is designed to heat the desiccant such that the desiccant is heated by the heater before entering the regenerator. A desiccant transfer conduit is connected to the dehumidifier and the regenerator and a desiccant supply conduit is connected to the dehumidifier and the regenerator such that the desiccant transfer conduit and the desiccant supply conduit form a desiccant transfer loop through the dehumidifier and the regenerator such that the desiccant loop provides transfer of desiccant from the dehumidifier to the regenerator via the desiccant transfer conduit and supply of desiccant from the regenerator to the dehumidifier via the desiccant supply conduit. The regeneration air is not in a closed cycle. Cooling is provided by receiving thermal energy from the internal environment.

It is an object of the present invention to provide a dehumidification system which recovers energy before discharge of volatile and hot air.

It is another object of the present invention provide a dehumidification system in which heat is not transferred to the outside environment.

It is a further object of the present invention to provide a dehumidification system whereby energy is used only for the purpose of dehumidification.

It is another object of the present invention provide a dehumidification system that uses a heat exchanger such that the outgoing/incoming liquid transfers the energy to each other.

It is another object of the present invention to provide a dehumidification system whereby the liquid is transferred long distances in the plastic pipes so as to allow the liquid to work with dehumidification terminals in independent zones.

These and other objects and advantages of the present invention will become apparent from a reading of the attached specification and appended claims.

BRIEF SUMMARY OF THE INVENTION

The present invention is a dehumidification system that comprises a solution, a refrigerant, a first heat exchanger cooperative the solution so as to pass a warmed solution therefrom, a second heat exchanger cooperative with the warmed solution so as to increase a temperature of the warmed solution, a radiator, a fan cooperative with the radiator such that the fan blows air across the radiator as the warmed solution is passed through or along the radiator and such that air absorbs moisture and increases in temperature as the air passes through the radiator, and an evaporator having the refrigerant passing along or through thereof. The evaporator cooperates with the increased temperature air such that heat from the increased temperature air is transferred to the refrigerant and such that moisture is created therefrom.

In the dehumidification system of the present invention, a housing is provided having an interior passageway. The radiator, the fan and the evaporator are positioned within the interior passageway of the housing. The first heat exchanger and the second heat exchanger are positioned outside of the housing. A compressor is cooperative with the evaporator and with the second heat exchanger so as to pressurize the refrigerant passing into the second heat exchanger. A pump is cooperative with the warmed solution so as to circulate the warmed solution through the second heat exchanger toward the radiator. The first conduit extends from the evaporator to the compressor. A second conduit extends from the second heat exchanger to the evaporator. The refrigerant passes through the first conduit. The refrigerant flows through the second conduit toward the compressor. An expansion valve is positioned on the second conduit so as to expand the refrigerant while passing toward the evaporator.

A drying zone is positioned exterior of the housing. The solution passes through the drying zone. The drying zone is formed upstream of the first heat exchanger. The first heat exchanger has an inlet, a first outlet and a second outlet. The first outlet is directed toward an interior of the housing such that the solution is received within the housing. The second outlet is directed toward the drying zone such that a remainder of the solution is directed toward the drying zone. The inlet extends toward the first heat exchanger from the drying zone. The housing has a first collector and a second collector therein. The first collector receives the warmed solution therein. The second collector receives the separated water therein. The second heat exchanger causes the warmed solution to increase to a temperature of greater than 65° C. The radiator increases the temperature of the air to in excess of 70° C.

A first pipe extends from the first collector to the pump. A second pipe extends from the pump to the second heat exchanger. A third pipe extends from the second heat exchanger to the radiator.

The present invention is also a process for dehumidifying in air. This process includes the steps of: (1) warming a solution; (2) passing the warmed solution over or through a radiator; (3) flowing air through the radiator such that the air increases in temperature and absorbs moisture; (4) passing a refrigerant through an evaporator; and (5) delivering the flowed air through the evaporator so as to cause moisture from the flowed air to be released from the flowed air.

In the process of the present invention, the radiator and the evaporator are positioned in a housing. The step of warming includes passing the solution through a first heat exchanger so as to increase the temperature of the solution to a temperature in excess of 65° C., and delivering the passed solution from the first heat exchanger into an interior of the housing.

The delivered solution is pumped through or over a second heat exchanger. The pumped delivered solution is moved to the radiator such that the pump delivered solution flows over or through the radiator. The step of flowing air includes blowing air through the radiator as the pumped delivered solution flows over or through the radiator so as to increase the temperature of the air to in excess of 70° C.

The step of passing the refrigerant includes passing the refrigerant from the evaporator through a compressor so as to increase the pressure of the refrigerant. The increased pressure refrigerant is moved from the compressor through the second heat exchanger such that the increased pressure refrigerant is in heat exchange relationship with the solution. The solution and the released moisture are collected within the interior of the housing. The step of warming the solution includes passing the solution for a drying zone into the first heat exchanger and passing a portion of the warm solution through the second heat exchanger.

The Section is intended to describe, with particularity, the preferred embodiment of the present invention. It is understood that modifications to this preferred embodiment can be made within the scope of the present claims without departing from the spirit of the invention. As such, this Section should not to be construed, in any way, as limiting of the broad scope of the present invention. The present invention should only be limited by the following claims and their legal equivalents.

BRIEF DESCRIPTION OF THE SEVERAL VIEWS OF THE DRAWINGS

FIG. 1 is a schematic illustration showing the dehumidification system of the present invention.

DETAILED DESCRIPTION OF THE INVENTION

Referring to FIG. 1, there is shown the dehumidification system 10 in accordance with the present invention. The dehumidification system 10 includes a solution 12, a refrigerant 14, a first heat exchanger 16, a second heat exchanger 18, a fan 20, an evaporator 22 and a radiator 24. The first heat exchanger 16 is cooperative with the solution 12 so as to pass a warmed solution 26 therefrom. The second heat exchanger 18 is cooperative with the warmed solution 26 so as to increase a temperature of the warmed solution. The fan 20 is cooperative with the radiator 24 such that the fan 20 blows air across the radiator as the warmed solution is passed through or along the radiator. This causes the air to absorb moisture and increase in temperature as the air passes through the radiator 24. The evaporator 22 has refrigerant 14 passing along or through thereof. The evaporator 22 is cooperative with the increased temperature air 28 such that heat from the increased temperature air 28 is transferred to the refrigerant 14 and such that moisture 39 is created therefrom.

In FIG. 1, it can be seen that there is a housing 30. The fan 20, the evaporator 22 and the radiator 24 are positioned within the housing 30. The housing 30 has an interior passageway 32 formed therein. As such, as indicated by the arrows, airflow 34 from the fan 20 is circulated through the interior passageway 32 of the housing 30 so as to move through the radiator 24 and through the evaporator 22.

Ultimately, moisture from the heated air will be collected in a collector 36 located at the bottom of the housing 30. The first heat exchanger 16 and the second heat exchanger 18 are positioned outside of the housing 30.

In FIG. 1, it can be seen that the heat exchanger 16 has a first inlet 38, a second inlet 40, a first outlet 42 and a second outlet 44. In particular, the solution from the drying zone can be delivered through the first inlet 38 into the first heat exchanger 16. The drying zone can include an extended length of plastic pipe so as to create a heat exchange relationship therein. The desiccant solution is heated within the heat exchanger 16 and passes outwardly therefrom through the first outlet 42. This solution is delivered into the interior of the housing 30. This desiccant solution 46 can be accumulated within the collector 48 located at the bottom of the housing 30.

A circulation pump 50 is connected to a first pipe 52. This first pipe 52 will extend into the accumulation of desiccant solution 46 within the housing 30. As such, there is always a supply of desiccant solution to be pumped by the circulation pump 50. The pump 50 delivers the desiccant solution 46 along a second pipe 54 to the second heat exchanger 18. A third pipe 56 will pass the heated desiccant solution 46 into the interior of the housing 30 and over and along with the radiator 24. Another pipe 58 is connected to the line 54 so as to deliver a portion of the desiccant solution back to the first heat exchanger 16. As such, this heated desiccant solution (by virtue of the heat) within the interior of the housing 30 can cooperate with the first heat exchanger 16 so as to further heat the desiccant solution passing therethrough. The pipe 58 will be connected to the second inlet 40 of the first heat exchanger 16. This desiccant solution that has flowed through the first heat exchanger 16 can be delivered to a drying zone along a pipe 60 extending from the second outlet of the first heat exchanger 16.

In FIG. 1, there is a compressor 62 that is cooperative with the evaporator 22 and with the second heat exchanger 18 so as to pressurize the refrigerant 14 passing into the second heat exchanger 18. A first conduit 64 extends from the evaporator 22 to the compressor 62. This first conduit 64 will have the refrigerant 14 passing therethrough. A second conduit 66 extends from the second heat exchanger 18 to the evaporator 22 such that the refrigerant 14 will flow toward the evaporator 22. An expansion valve 68 is positioned on the second conduit 66 so as to expand the refrigerant during the passage toward the evaporator 22.

In the present invention, the second heat exchanger 18 serves to cause the warmed solution to increase to a temperature greater than 65° C. The radiator 24 serves to increase the temperature of the air to in excess of 70° C.

With reference to FIG. 1, the fan 20 is positioned on one side of the radiator 26 so as to create the airflow 34 within the interior passageway 32 of the housing 30. This enables the air to remain in a constant cycle in a regeneration zone. The separated water 72 is positioned in this zone. As such, the separated water 72 can be discharged, as required. The solution 46 is located within the interior of the housing 30 in the collector 48 and positioned so as to allow the circulation pump 50 to properly draw the solution 46 therefrom and toward the second heat exchanger 18. The radiator 24 is used for mixing the heated solution with air. This will cause the temperature of the air to increase and to become moisture-laden. Any remaining solution from the radiator 24 will be poured back into the collector 48.

The second heat exchanger 18 is a condenser heat exchanger. This enables the heating of the solution through the use of the refrigerant 14. The compressor 62 serves to compress the refrigerant. The second conduit 66 includes the refrigerant having reduced enthalpy. The conduit 70 is located between the expansion valve 68 and the evaporator 22. This conduit has cold refrigerant with low-pressure. The first conduit 64 includes a warm refrigerant having low-pressure.

The first inlet 38 is connected to the desiccant solution supply 12. This desiccant solution is weakened after absorbing the moisture from the media at the ambient temperature. The first heat exchanger 16 serves to heat the desiccant solution from the drying zone and cool the solution leading to the drying zone through the pipe 60. The concentrated desiccant solution will flow through the pipe 60 from the second outlet 44 of the heat exchanger 16. The first outlet 42 of the first heat exchanger 16 has the dilute desiccant solution passing toward the housing 30. The desiccant solution is weakened after absorbing the moisture from the media and from the heat of the heat exchanger 16. The pipe 58 leading to the second inlet 40 transfers a concentrated solution from the regeneration zone and is directed toward the drying zone by passing through the first heat exchanger 16.

The evaporator 22 enables the cooling of the hot and humid air so as to condense the air. As such, moisture from the air can be directed, by gravity, downwardly so as to reside as water 72 within the collector 36.

In the present invention, condensation is created at a temperature of 70° or above. The solution is increased to a temperature of at least 65° C. When the solution is increased to a temperature of about 65° C., the solution is ready for regeneration. The water that is separated from the solution is result of contact of the hot solution with the air on the wide surface of the radiator 24. The energy of the heated and humidified air is drawn after encountering the evaporator and cooled so that water is condensed. The separated water is directed to the collector 36 by means of gravity. The warm air, however, will enter into the cycle by means of the fan 20. The solution 46 has been separated from the water 72 but its temperature is higher than the ambient temperature. As a result of the heat exchanger placed between the inlet and outlet of the regeneration zone, heat transfer is enabled and heat transfer to the media is prevented.

The present invention provides for the separation of water from the solution that is provided in the regeneration zone. Since the solution is incoming to and outgoing from this zone, the thermal energy is retained within the regeneration zone. Energy is not transferred to the external environment by the solution. The solution is not transferred to the external environment. The solution from the drying zone first passes through the first heat exchanger 16 and is then transferred to the collector 48. The solution 46 is drawn from collector 48 and passes through the condenser heat exchanger 18 through the use of the circulation pump 50 and is brought to a temperature of above 65° C. This hot solution is cooperative with the air blown by the closed-cycle air circulation fan 20 by being poured down the radiator 24. The air passes through the radiator 24 so as to absorb the moisture and increase in temperature. This air, having increased temperature and humidity, will encounter the evaporator 22. As a result of this encounter, the heat is transferred to the refrigerant and water is formed by the condensation of the moisture. No transfer of energy is provided from the heat pump to the external environment. The difference in energy between the evaporation and condensation of the heat pump is balanced by the enthalpy of the warmed water and a slight amount of heat loss in the solution is transferred to the drying zone and the heat loss of the compressor. A slight amount the heat loss of the solution and the heat loss of the compressor is transferred to the drying zone.

The foregoing disclosure and description of the invention is illustrative and explanatory thereof. Various changes in the details of the illustrated construction or in the steps of the described process can be made within the scope of the appended claims without departing from the spirit of the invention. The present invention should only be limited by the following claims and their legal equivalents.

I claim:

1. A dehumidifier system comprising:

a solution;

a refrigerant;

a first heat exchanger cooperative with said solution so as to pass a warmed solution therefrom;

a second heat exchanger cooperative with the warmed solution so as to increase a temperature of the warmed solution;

a radiator;

a fan cooperative with said radiator such that said fan blows air across said radiator as said warmed solution is passed through or along said radiator and such that air absorbs moisture and increases in temperature as the air passes through said radiator;

an evaporator having said refrigerant passing along or through thereof, said evaporator corporative with the increased temperature air such that heat from the increased temperature air is transferred to said refrigerant and such that moisture is created therefrom; and a housing having an interior passageway, said radiator and said fan and said evaporator positioned in said interior passageway of said housing such that a flow of the air from said fan is circulated through the interior passageway of said housing so as to move through said radiator and through said evaporator, said housing having a first collector that receives the warmed solution and has a second collector that receives separated water therein.

2. The dehumidifier system of claim 1, said first heat exchanger and said second heat exchanger positioned outside of said housing.

3. The dehumidifier system of claim 1, further comprising:

a compressor cooperative with said evaporator and with said second heat exchanger so as to pressurize said refrigerant passing into said second heat exchanger.

4. The dehumidifier system of claim 1, further comprising:

a pump cooperative with the warmed solution so as to circulate the warmed solution through said second heat exchanger toward said radiator.

5. The dehumidifier system of claim 3, further comprising:

a first conduit extending from said evaporator to said compressor, said first conduit having said refrigerant passing therethrough; and a second conduit extending from said second heat exchanger to said evaporator such that said refrigerant flows toward said evaporator.

6. The humidifier system of claim 5, further comprising:

an expansion valve positioned on said second conduit so as to expand said refrigerant prior to passing toward said evaporator.

7. The humidifier system of claim 1, further comprising:

a drying zone positioned exterior of said housing, said solution passing through said drying zone, said drying zone formed upstream of said first heat exchanger.

8. The humidifier system of claim 7, said first heat exchanger having an inlet and a first outlet and a second outlet, said first outlet directed toward an interior said housing such that said solution is received within said housing, said second outlet directed toward said drying zone such that a remainder of said solution is directed toward said drying zone, said inlet extending toward said first heat exchanger from said drying zone.

9. The humidifier system of claim 8, said housing having a first collector and a second collector therein, said first collector receiving the warmed solution therein, said second collector receiving the separated water therein.

10. The dehumidifier system of claim 1, said second heat exchanger causing the warmed solution to increase to a temperature of greater than 65° C.

11. The humidifier system of claim 1, said radiator increasing the temperature of the air to in excess of 70° C.

12. The dehumidifier system of claim 9, further comprising:

a pump cooperative with the warmed solution so as to circulate the warmed solution through said second heat exchanger toward said radiator;

a first pipe extending from said first collector to said pump;

a second pipe extending from said pump to said second heat exchanger; and a third pipe extending from said second heat exchanger toward said radiator.

13. A process for dehumidifier air, the process comprising:

warming a solution;

passing the warmed solution over or through a radiator;

flowing air through said radiator such that the air increases in temperature and absorbs moisture;

passing a refrigerant through an evaporator;

delivering the flowed air through said evaporator so as to cause moisture from the flowed air to be released from the flowed air.

14. The process of claim 13, said radiator and said evaporator positioned in a housing, the step of forming comprising:

passing the solution through the first heat exchanger so as to increase a temperature of the solution to a temperature of above 65° C.; and delivering the passed solution from a first heat exchanger into an interior of said housing.

15. The process of claim 14, further comprising:

pumping a delivered solution through or over a second heat exchanger, the step of passing the warmed solution comprising moving the pumped delivered solution to said radiator such that the pumped delivered solution flows over or through said radiator.

16. The process of claim 15, the step of flowing air comprising:

flowing air through said radiator as the pumped delivered solution flows over or through said radiator so as to increase the temperature of the air to in excess of 70° C.

17. The process of claim 15, the step of passing the refrigerant comprising:

passing the refrigerant from said evaporator through a compressor so as to increase a pressure of the refrigerant; and moving the increased pressure refrigerant from the compressor through said second heat exchanger such that the increased pressure refrigerant is in heat exchange relationship with the solution.

18. The process of claim 14, further comprising:

collecting the solution within an interior of said housing; and collecting the released moisture within said interior of said housing.

19. The process of claim 14, the step of forming the solution comprising:

passing the solution from a drying zone into said first heat exchanger; and passing a portion of the warmed solution from the first heat exchanger.

* * * * *